US005361574A

United States Patent [19]

Gebhardt

[11] Patent Number: 5,361,574

[45] Date of Patent: Nov. 8, 1994

[54] PROCESS AND DEVICE FOR PNEUMATIC FEEDING OF FIBERS TO THE FIBER COLLECTION SURFACE OF AN OPEN-END SPINNING ELEMENT

[75] Inventor: Wolfgang Gebhardt, Kosching, Germany

[73] Assignee: Rieter Ingolstadt Spinnereimaschinenbau AG, Ingolstadt, Germany

[21] Appl. No.: 107,247

[22] Filed: Aug. 16, 1993

[30] Foreign Application Priority Data

Aug. 22, 1992 [DE] Germany ..... 4227885

[51] Int. Cl.[5] ..... D01H 4/30; D01H 4/32; D01H 4/36

[52] U.S. Cl. ..... 57/408; 57/411; 57/412; 57/413

[58] Field of Search ..... 57/408, 411, 413, 412; 19/200, 203, 204, 205, 296, 304

[56] References Cited

U.S. PATENT DOCUMENTS

| | | | |
|---|---|---|---|
| 3,360,917 | 1/1968 | Kubovy et al. | 59/411 |
| 3,557,543 | 1/1971 | Krause . | |
| 3,584,951 | 6/1971 | Chrtek et al. | 57/411 |
| 3,800,520 | 4/1974 | Schiltknecht | 57/411 |
| 3,943,690 | 3/1976 | Noguera | 57/406 X |
| 3,968,636 | 7/1976 | Junek et al. . | |
| 4,169,348 | 10/1979 | Blackburn | 57/408 |
| 4,249,370 | 2/1981 | Vecera et al. | 57/411 X |
| 4,505,102 | 3/1985 | Landwehrkamp et al. | 57/413 X |
| 4,704,853 | 11/1987 | Lawrence | 57/408 X |
| 4,976,099 | 12/1990 | Brockmanns et al. | 57/411 |
| 5,088,266 | 2/1992 | Wassenhoven | 57/408 |
| 5,095,689 | 3/1992 | Ferro et al. | 57/413 X |

FOREIGN PATENT DOCUMENTS

| | | |
|---|---|---|
| 2131270 | 1/1972 | Germany . |
| 2811881A1 | 9/1979 | Germany . |
| 1357211 | 6/1974 | United Kingdom . |

*Primary Examiner*—Daniel P. Stodola
*Assistant Examiner*—William Stryjewski
*Attorney, Agent, or Firm*—Dority & Manning

[57] ABSTRACT

In conveying fibers (20) pneumatically to the fiber collection surface of an open-end spinning element, the fibers (20) fed into the fiber feeding channel (4) are detached from the wall (42) of the fiber feeding channel (4)which follows the fiber-guiding peripheral wall (12) of the opener roller (10) preceding the fiber feeding channel (4) and are fed to the zone of high flow speed. For this purpose the concave peripheral wall (12) preceding the fiber feeding channel (4) merges via a convex surface (41) of such configuration and length into the wall (42) of the fiber feeding channel (4) that a tangent (43) applied to the end of the concave peripheral wall (12) preceding the fiber feeding channel (4) intersects the opposite wall (420) of the fiber feeding channel (4). Along that wall (420) which is intersected by the tangent (43), an air conveying channel (6) lets out into the fiber feeding channel (4), it being possible to convey an auxiliary air stream (80) through it to the fiber feeding channel (4) in a direction contrary to the direction of rotation of the opener roller (10). As a result, the fibers (20) are brought into the zone of higher flow speed and are maintained therein.

11 Claims, 1 Drawing Sheet

PROCESS AND DEVICE FOR PNEUMATIC FEEDING OF FIBERS TO THE FIBER COLLECTION SURFACE OF AN OPEN-END SPINNING ELEMENT

BACKGROUND OF THE INVENTION

The instant invention relates to a process for pneumatic feeding of fibers to the fiber collection surface of an open-end spinning element, whereby a fiber sliver is opened by the clothing of predetermined width of an opener roller into individual fibers and is fed in this form through a fiber feeding channel in the center of which the air has a high flow speed on its way to a fiber collection surface.

In a known process of this type (DE-OS 2,131.270, FIG. 1) the conveying air stream with the fibers is guided in a fiber feeding channel tangentially following a widening area inside the opening roller housing. These fibers are thereby going mainly into a border layer along the widening area and the side of the fiber feeding channel following it, where the speed of the air stream is greatly decelerated. The fibers are therefore not stretched sufficiently in the fiber feeding channel.

OBJECTS AND SUMMARY OF THE INVENTION

It is therefore a principal object of the invention to create a process and a device by means of which better stretching of the fibers is achieved in the fiber feeding channel. Additional objects and advantages of the invention will be set forth in part in the description which follows, and in part will be obvious from the description, or may be learned by practice of the invention.

The objects are attained through the invention in that the fibers fed into the fiber feeding channel are detached from the side of the fiber feeding channel which follows the preceding fiber-guiding peripheral wall of the opener roller, and are brought back into the zone of high air flow speed. In this manner the fibers conveyed with the conveying air stream are not subjected to the deceleration effect of the slow boundary layer of air but are effectively stretched in the center of the conveying air stream due to its high flow speed and reach the fiber collection surface of the open-end spinning element in that state.

In another advantageous embodiment of the process according to the invention it is possible to provide for an auxiliary air stream which is fed into the fiber feeding channel against the rotational direction of the opener roller to be introduced into the fiber feeding channel along the wall which is opposite the wall from which the fibers have been detached, contributing in holding the fibers detached from the facing wall to be held within the zone of high flow speed. This auxiliary air stream, together with the detaching action of fibers from the facing wall of the fiber feeding channel, cause the fibers to be fed to the spinning element in the area of high flow speed. This is due to the fact that the flow profile in the fiber feeding channel is shifted by the auxiliary air stream with its maximum values toward the center of the fiber feeding channel.

In order to achieve low pressure losses and thereby sufficiently high flow speeds of the auxiliary air flow, the latter is advantageously fed to the fiber feeding channel over a width which is substantially equal to the width of the clothing of the opener roller.

It has been shown to be advantageous if the direction of the conveying air stream which detaches the fibers from the wall of the fiber feeding channel and the auxiliary air stream are oriented toward each other in such a manner that the fibers which are detached from the wall of the fiber feeding channel are conveyed in the direction of the zone within the fiber feeding channel in which the conveying air stream and the auxiliary air stream unite, whereby they are being conveyed to this zone preferably only when the offset of the flow profile of these two air streams is essentially completed.

To carry out the process, the invention provides that the concave peripheral wall of the housing preceding the fiber feeding channel merges into the inner wall of the fiber feeding channel over a convex curve of such form and length that a tangent which is applied to the end of a concave peripheral wall preceding the fiber feeding channel intersects the opposite wall of the fiber feeding channel. The conveying air stream with the fibers at first follows this tangent until the fibers are gradually moved into the longitudinal orientation of the fiber feeding channel with increased penetration into the zone of higher flow speed. In this manner, the fibers remain in the zone of higher flow speed where they are stretched so that they reach the spinning element in a stretched state.

It has been shown to be advantageous if the intersection of the tangent with the wall of the fiber feeding channel is selected so that it is at a distance from the beginning of that wall toward the opener roller, which is less than the six times larger than the intake width of the fiber feeding channel measured at the beginning of that wall, at a right angle to the center axis of the fiber feeding channel.

To be able to determine the precise area within the zone of high flow speed in which the fibers are fed to the spinning element, an air conveying channel through which an auxiliary air stream can be fed into the fiber feeding channel in a direction opposite to the rotational direction of the opener roller preferably lets out into the fiber feeding channel along the wall which is intersected by the tangent. This air conveying channel has advantageously a width which is substantially equal to the width of the clothing of the opener roller and thereby also of the fiber feeding channel.

It is especially advantageous for fiber conveying and fiber stretching if the tangent intersects the zone in which the conveying air stream unites with the auxiliary air stream.

Air eddies in the auxiliary air stream fed to the fiber feeding channel from the air feeding channel should be avoided as much as possible so as not to affect the fiber orientation. For this reason a rounded edge is advantageously provided where the air guiding channel enters the fiber feeding channel.

The process and the device according to the invention, by giving the opener roller housing and the transition point into the fiber feeding channel an appropriate configuration in a simple manner, and by means of a possibly added appropriate air guidance of the air flow fed to the spinning element, make it possible for the fibers to enter the zone of highest air flow speed in the fiber feeding channel and that they also remain therein. As a result the fibers are stretched on their way to the spinning element and reach the fiber collection surface of the spinning element in a stretched state, there to be incorporated in a known manner into the end of a continuously withdrawn yarn. The latter is given a better quality in this manner.

The invention is explained below in greater detail through examples of embodiments.

DESCRIPTION OF THE PREFERRED EMBODIMENTS

Figure 1:
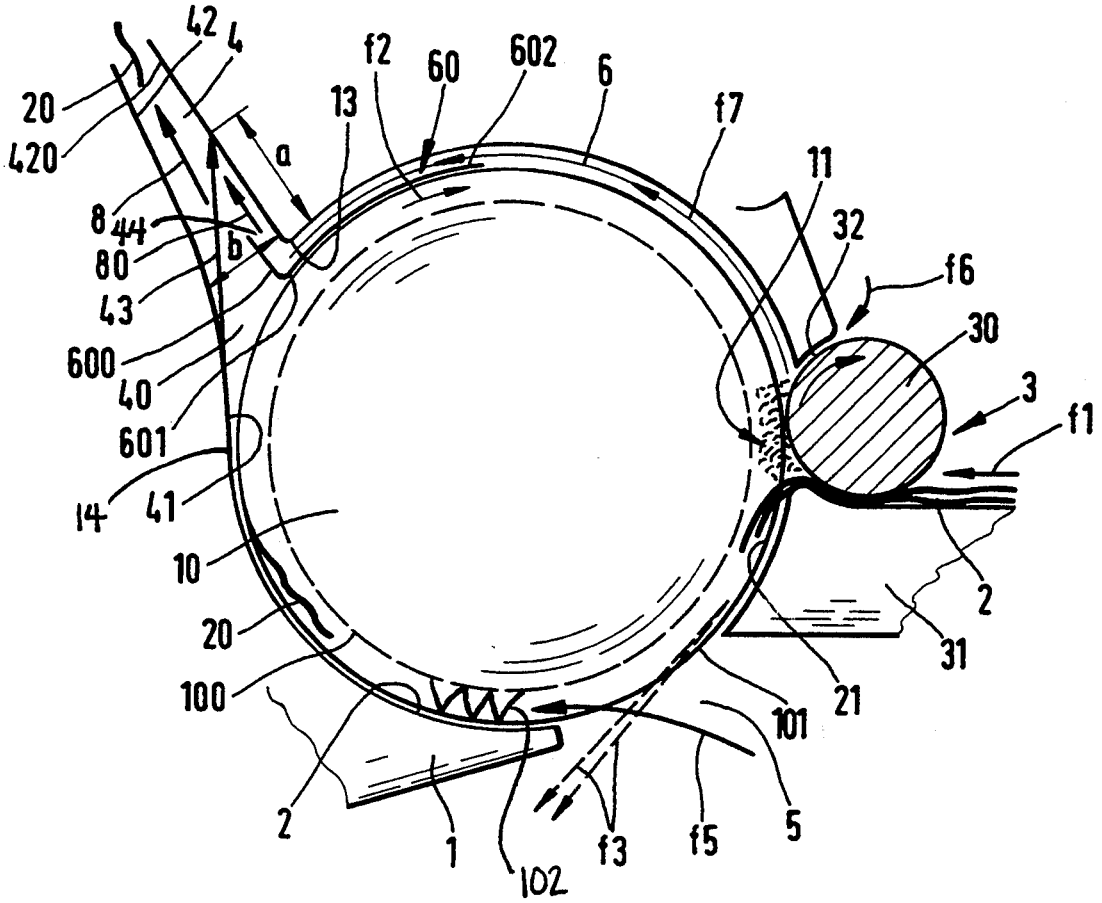
FIG. 1 shows an opener roller housing according to the invention, in a side view

Reference will now be made in detail to the presently preferred embodiments of the invention, one or more examples of which are illustrated in the accompanying drawings. Each example is provided by way of explanation of the invention, not limitation of the invention. Features illustrated or described as part of one embodiment, can be used on another embodiment to yield a still further embodiment. The numbering or components in the drawings is consistent throughout the application, with the same components having the same number in each of the drawings.

FIG. 1 shows an opener roller housing 1 with an opener roller 10. The latter has a circumferential surface provided with a clothing between two end disks which can be integral parts of the opener roller 10. The base circle 100 of this clothing is represented in FIG. 1 by a broken line, while the top circle 101 is represented by a solid line.

Fiber material in form of a fiber sliver 2 is fed to the opener roller 10 in the direction of arrow fl by means of a feed device 3. The latter is provided with a delivery roller 30 and with a feed trough 31 interacting elastically with the latter. The feed device 3 is located in an opening 11 in the peripheral wall 12 of the opener roller housing 1.

The opener roller 10 rotates during operation in the direction of arrow $f_2$ and thereby conveys the fibers 20 detached from the leading end of the fiber sliver 2 in a fiber feeding channel 4 through which the fibers 20 are conveyed by means of a conveying air stream to a open-end spinning element (not shown) to be spun into yarn.

In the direction of fiber conveying, between the feed device 3 and the fiber feeding channel 4, a dirt elimination opening 5 is provided in the peripheral wall 12 of the housing 1, through which dirt particles detached from the fibers 20 are eliminated (see arrow $f_3$).

In the not shown open-end spinning element negative pressure prevails, causing air to be aspired through the fiber feeding channel 4. The major portion of this air is aspired through the dirt elimination opening 5 (see arrow $f_5$) and constitutes the already mentioned conveying air stream 8. A smaller portion of the air is aspired through opening 11 in the opener roller housing 1 (arrow $f_6$).

As FIG. 1 shows, the wall 42 of the fiber feeding channel 4 shown on the left does not merge into the peripheral wall 12 of housing 1, as was ordinarily the case until now. On the contrary, the fiber feeding channel 4 is given a certain slope, so that the direction of flow in the fiber feeding channel 4 has a certain radial component. The passage from the concave peripheral wall 12 of the housing 1 into the fiber feeding channel 4 takes place in this case via a convex surface 41 which causes the fibers 20 to become detached from the wall 42 of the fiber feeding channel 4 across from the opener roller 10 as they are conveyed to the center of the fiber feeding channel 4 where the air speed is higher than in the areas of the channel walls.

FIG. 1 shows that the passage from the inner space of housing 1 into the fiber feeding channel 4 is designed so that a tangent 43 which is applied to the end of the concave peripheral wall 12 of housing 1 which precedes the convex surface 41 intersects the facing wall 420 of the fiber feeding channel 4. If the curvature or length of the convex surface 41 is insufficient, so that the tangent 43 remains essentially within the fiber feeding channel 4, the desired detaching process which is described below will not be sufficient. It has been shown that the distance a of the intersection of tangent 43 and wall 420 must be less than six times the intake width b of the fiber feeding channel 4 (measured at the beginning of this wall 420, at a perpendicular to the center axis of the fiber feeding channel 4) in order to yield optimal results.

The convex surface 41 is of such length and configuration that the tangent 43, and thereby the fibers conveyed along this tangent are detached from the wall 42. In order to achieve this, and with the conditions prevailing because of the speed of the opener roller 10, the cross section of the fiber feeding channel 4 and the negative spinning pressure, it must be ensured that the curvature of the convex surface 41 exceeds a certain convexity so that the fibers 20 do not follow the curvature of the convex surface 41. On the other hand, changes in direction must be continuous and not sudden so that air eddies and tearing at edges due to air flow may be avoided, since these would exercise a detrimental influence on the position of fibers and fiber fly. In order to ensure that the fibers 20 are detached from the wall 42, the convex surface 41 must also be of a certain length—as seen in the longitudinal direction of the fiber feeding channel 4.

The fibers 20 detached from the convex surface 41 move further and further into the center of the conveying air stream 8 and thereby into the zone of higher flow speed, so that the fibers 20 are accelerated considerably in the direction of flow. If the factors determining the fiber fly (size and quantity of air intake openings in housing 1, rotational speed of the opener roller 10, curvature of the convex surface 41, i.e. general geometry of the opening zone, negative spinning pressure and thereby flow speed in the fiber feeding channel 4, etc.) are properly coordinated, the fibers 20 are held in the zone of high flow speed and do not reach the wall 420 of the fiber feeding channel 4 across from wall 42.

It is not necessary for the peripheral wall 12 to have constant concavity before the convex surface 41. This concavity can also decrease slightly, either continuously or possibly also in small steps, in the direction of the convex surface 41, with these concave surfaces no longer extending concentrically with the opener roller 10. In that case the above-mentioned tangent 43 is to be applied to the end of the last concave surface before the convex surface.

To increase the certainty that the fibers 20 will not reach this wall 420, the peripheral wall 12 of housing 1 in the shown embodiment is at a greater distance from the top circle 101 of the opener roller 10 in the area between the inlet opening 40 of the fiber feeding channel 4 and the opening 11 receiving the feed device 3 than in the peripheral area between feed device 3 and fiber feeding channel 4.

The described form and arrangement of the convex surface 41 at the inlet of the fiber feeding channel 4 has the following advantageous effects:

The convex surface 41 detaches the fibers 20 as they enter the fiber feeding channel 4 from a guiding wall and brings them instead essentially into the center of a high air stream speed zone. This speed even increases in the fiber feeding channel 4, since the feeding channel tapers. As a result higher traction forces act upon the fibers 20 at their leading end than at their trailing end, resulting in a stretching and parallel orientation of the fibers 20.

Since the fibers 20 are within the cross-sectional area of the fiber feeding channel 4 where they are subjected to the highest air stream speed, they remain there for as long as the fiber feeding channel 4 maintains its direction. The fibers 20 are therefore conveyed away from the wall over their entire route and also leave the fiber feeding channel 4 at the point where flow is most favorable. If, on the other hand, the fibers 20 would be near the channel wall as they leave the fiber feeding channel 4 in the usual manner, they would be subject to a scattering process and would be fed to the fiber collection surface, e.g. into the collection groove of a spinning rotor with different orientations and positions.

The essentially centric guidance of the fibers 20 in the fiber feeding channel 4, i.e. in the area of highest air stream speed, makes it possible to have the fibers 20 leave the fiber feeding channel 4 not only in a predetermined direction, with a predetermined orientation and at a predetermined speed, but the fibers 20 are deposited on the fiber collection surface in this controlled manner. If a spinning rotor is used, the fibers are deposited on the rotor sliding wall under optimal sliding and incorporation conditions, leading to an optimal formation of yarn in the best possible manner.

A circulation flow is created with the rotation of the opener roller 10 in the opener roller housing 1. Part of it exits, as mentions, through the fiber feeding channel 4 and thereby takes along the fibers 20 which have detached themselves in the meantime from the clothing of the opener roller 10. Some fiber fragments are however unable to detach themselves from the clothing for some reason (perhaps because they were imbedded more deeply in the clothing than the fibers 20 which have reached the fiber feeding channel 4 and continue to be conveyed between the teeth of the clothing in the direction of the feed device 3. At this point the leading end of the fiber sliver 2 extends in the form of a fiber tuft 21 into the area between the clothing teeth and thus bars the way to the air stream circulating together with the opener roller 10. The air now tries to escape from the housing 1 through the gap 32 remaining between the delivery roller 30 and the housing wall.

The friction losses in the air conveying channel 6 between fiber feeding channel 4 and feed device 3 are kept low, so that an air flow directed against the direction of rotation (arrow $f_2$) in the area of the air conveying channel 6 increases. If the flow losses are so small that a stronger air stream is produced in the direction of arrow $f_7$, this air stream causes air to enter the housing 1 through gap 32 in the direction of arrow $f_6$. This air stream flowing into housing 1 causes fiber fragments, dirt and dust particles which have been prevented from continuing in the direction of arrow $f_2$ in housing 1 because of the fiber tuft 21 extending toward the opener roller 10 and which therefore tend to accumulate near the opening 11 and therefor near the feed device 3 to be taken from here to the fiber feeding channel 4, in the direction of arrow $f_7$, against the rotational direction $f_2$ of the opener roller 10. The accumulation of fiber fragments, etc. in the area of the feed device 3 is thus avoided. Fly is thus avoided inside housing 1 as well as outside, since the fiber fragments etc. can neither accumulate here, nor can they leave the housing 1.

As shown in FIG. 1, the air conveying channel 6 is separated by an intermediary wall 60 from the rest of the interior of housing 1 in the area toward the fiber feeding channel. The intermediate wall 60 has a section 600 extending into the intake opening 40 of the fiber feeding channel 4 and oriented in the longitudinal direction of the fiber feeding channel 4, being connected via a curved intermediate section 601 to the main section 602. The auxiliary air stream 80 which is fed to the fiber feeding channel 4 in the direction of arrow $f_7$ and which carries along fiber fragments, etc. is deflected by the intermediate wall 60 in the direction of fiber feeding channel 4 so that turbulence is voided there. The air conveying channel 6 is of a width over its length that is always essentially equal to the width of the clothing of the opener roller 10, so that a correspondingly wide air stream is maintained until fiber feeding channel 4.

Due to the dimensions and orientation of the air conveying channel 6, an auxiliary air stream 80 of such force flows out of it so that it not only removes fiber fragments from the fly-endangered area near the feed device 3 in side and outside housing 1 into the fiber feeding channel 4, but so that it has a flow speed that is so high near the wall 420 that fibers 20 which have been conveyed into the fiber feeding channel 4 based on the convex surface 41 do not cross the zone of high flow speed but are prevented by the auxiliary air stream from doing so. The fibers 20 conveyed with the conveying air stream therefore do not come in proximity of wall 420, where a relatively slow moving boundary layer of air is found as is the case in proximity of wall 42. Rather, the fibers 20 remain in the zone of higher flow speed which is more favorable for fiber stretching.

While the convex surface 41 causes the fibers 20 to lift off and to be detached from the wall which formerly guided them, the auxiliary air stream ensures corrective action even with changing conditions with respect to fiber fly characteristics, fiber material or fiber length in that the fibers 20 are prevented from crossing the zone of higher flow speed and to reach wall 420. This is due to the fact that the auxiliary air stream causes a shifting of the zone of high air stream speed in the direction away from wall 420.

The design is such that a tangent 43 applied to the transition point of the concave peripheral wall 12 of housing 1 or, if several segments with different concavity are provided before the intake into fiber feeding channel 4, to the transition point of this last concave segment of the peripheral wall 12 before the convex surface 41 and placed in this surface 41 intersects the wall 420 of the fiber feeding channel 4 which is toward the air conveying channel 6—in particular in such a manner that this tangent 43 intersects zone 44 in which the conveying air stream fed to fiber feeding channel 4 through intake opening 40 and the auxiliary air stream 80 which is fed through the air conveying channel 6 are united.

The air flow forming along wall 420 across from wall 42 of the fiber feeding channel 4 prevents the fibers 20 from sliding along wall 420 of the fiber feeding channel 4 and instead holds them at a distance from that wall 420. This causes the fibers 20 to be conveyed at a distance from wall 42 as well as from wall 420, this being of significant importance for the fiber stretching and fiber orientation of the fibers 20 arriving at the spinning element to be spun.

It is not necessary here, and often is not desirable, for the fibers 20 to actually reach this zone 44 since the auxiliary air stream 80 has merely a safety function. However, to enable this auxiliary air stream 80 to carry out this task, the fibers 20 conveyed by the conveying air stream 8 are conveyed in a direction oriented toward zone 44 as they leave the peripheral wall 12 of the opener roller 10 (tangent 43).

It was briefly mentioned above that the fibers 20 can be held by the auxiliary air stream 80 easily in the zone of high to highest air stream speed. While the air flow speed increases from wall 42 in direction of wall 420 without the air conveying channel 6, due to the flow conditions in housing 1 in fiber feeding channel 4 (aside from the slowly flowing boundary air layers) because the air flow conditions propagate themselves from the area between peripheral 12 of housing 1 and opener roller 10 essentially as far as into the fiber feeding channel 4, the conditions are somewhat different when an auxiliary air stream 80 is provided. By introducing the auxiliary air stream 80 into the fiber feeding channel 4, the air flow profile in the area of the conveying air stream 8 conveying the fibers 20 becomes somewhat narrower and higher. In the zone in which the conveying air stream 8 and the auxiliary air stream 80 unit (zone 44) the air flow profile of the auxiliary air stream 80 is present on the side toward wall 420. The two air stream profiles together produce a new flow profile (after offset of the two flow profiles), whose zone of high to highest flow speed is found further away from wall 420 than in a fiber feeding channel 4 into which no auxiliary air stream is introduced.

For the above reasons it is especially advantageous for a conveying of fibers at a distance from the walls if the geometric conditions are designed so that the fibers 20 reach the unification zone 44 only when the offset between the flow profiles has been substantially completed.

A certain amount of air is required to feed fibers 20 to the spinning element. It is therefore important to coordinate air management in the opener roller housing 1 with this. Compared to previously known designs, in which no air conveying channel 6 was provided, no other overall air quantity is needed in the fiber feeding channel 4. Since however part of the air should penetrate into the opener roller housing 1 through the gap 32 (arrow re), this part of the air must be deducted away from the air mass which is aspired through the dirt elimination opening 5 into housing 1. This division of the air is achieved in that the distance between the peripheral wall 12 of housing 1 and the opener roller 10, i.e. the free space between the opener roller 10 and the peripheral wall 12 of housing 1 surrounding the opener roller 10, between the dirt elimination opening 5 and the inlet opening 40 into the fiber feeding channel 4 is reduced to produce somewhat smaller cross sections. In this manner, less air than in conventional models can be conveyed between the peripheral wall 12 of housing 1 and the opener roller 10, so that the air stream sucked through the fiber feeding channel 4 to the spinning element must include as part of its requirement air drawn through the gap 32. The air conveying channel 6 extending to the fiber feeding channel 4 is sized in such manner in relation to the above-mentioned free space that this free space and the air conveying channel 6 together produce the desired total air flow (for a given negative pressure in the fiber feeding channel 4).

Even though these fiber fragments etc. go from the area of the feed device 3 into the fiber feeding channel 4 and therefore also to the spinning element where they are incorporated into the newly produced yarn, these fiber fragments do not increase the danger of yarn breakage. This is due to the fact that their number and frequency are so minimal that they cannot affect the strength of the yarn to be produced.

In order to keep pressure losses in the air conveying channel 6 as low as possible, the edge 13 which is located at the inlet of the air conveying channel 6 into the fiber feeding channel 4 is rounded off. Turbulence which takes effect as far as in zone 44 which can exert a detrimental influence on the fibers 20 is thus avoided.

Figure 2:
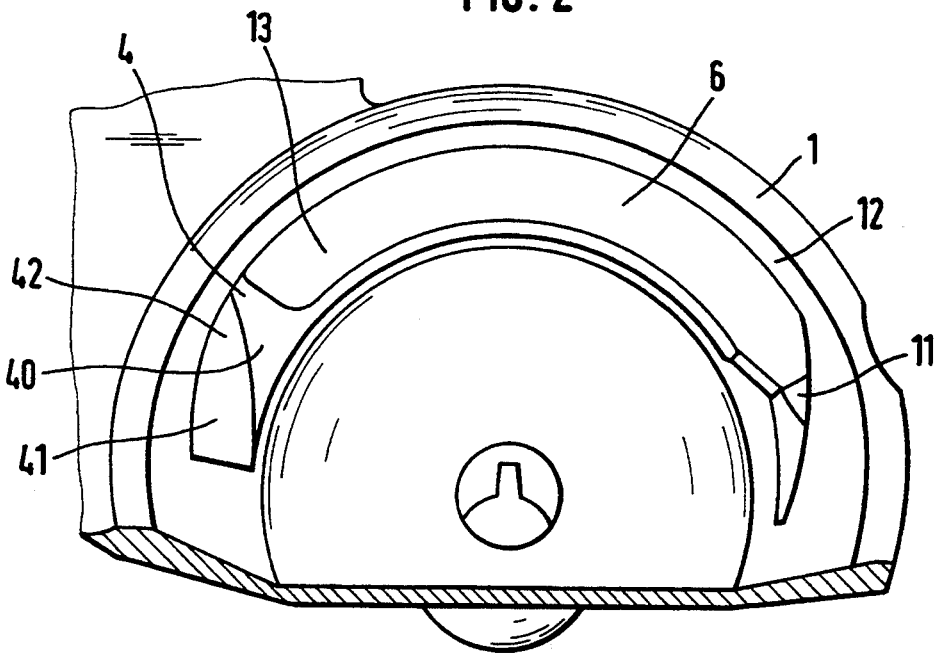
FIG. 2 shows a variation of an opener roller housing in perspective view.

The invention is not tied to the forms and designs shown and explained. Within the framework of the invention, processes and devices can be varied in countless ways, e.g. by exchanging characteristics against equivalents or through other combinations of characteristics. Such a variant is shown in FIG. 2, for example, according to which intermediate wall 60 (in form of an inserted piece of sheet metal or a cup-shaped insert) can be omitted and where the air conveying channel 6 is not separated by any kind of intermediate wall 60 from the interior space of the opener roller housing 1 surrounding the opener roller 10. This air conveying channel 6 is installed in a widening peripheral zone of the opener roller housing 1, its depth being so great that pressure losses are low. As mentioned earlier, fiber accumulations near the opening 11 inside and outside the opener roller housing i are avoided, since the auxiliary air stream 80 entering the opener roller housing 1 through gap 32 of opening 11 seizes all detached fiber fragments etc. circulating with the opener roller 10 and conveys them through the air conveying channel 6 into the fiber feeding channel 4 where this auxiliary air stream 80 contributes in keeping the fibers 20 conveyed with the conveying air stream 8 in the zone of high flow speed.

The invention is described above through embodiments in which an auxiliary air stream 80 along the wall 420 of the fiber feeding channel 4 is produced through the design of a air conveying channel 6. It is however obvious that this air conveying channel 6 can be omitted with an appropriate design of the convex surface 41, since the auxiliary air stream flowing in it merely carries out a safety function, insofar as the fiber fly in the fiber feeding channel 4 is concerned.

When such an auxiliary air stream 80 is provided, it should extend substantially over the entire clothing width. However, since the fiber feeding channel 4 tapers from its inlet opening 40 in direction of the spinning element in order to impart a relatively high acceleration to the fibers 20, the width of the auxiliary air stream 80 can be lowered in adaptation to the width of the fiber feeding channel 4 in zone 44, in particular in view of the fact that normally no fibers 20 are present in the area of the clothing edge so that therefore no fibers 20 (with the exception of a few "escapees") are conveyed in the lateral border area of the fiber feeding channel 20.

The width of the auxiliary air stream 80 is determined by the width of the air conveying channel 6 as described. Since the opening 11 with feed device 3 can be of lesser width than the clothing of the opener roller 10 so as not to convey any "escapees" in the lateral area of the clothing if possible, the air conveying channel 6 therefore widens according to FIG. 2 from a starting width that is equal to the width of opening 11 to the desired final width in the area of the passage into the fiber feeding channel 4. In the embodiment shown in FIG. 2 the opening 11 is therefore narrower than the air conveying channel 6.

So that all the fibers, even those which are in the outermost conveying zone of the opener roller 10 can be removed through the fiber feeding channel 4, the latter is also of a width that is greater than the feeding width of the fiber sliver 2 to the opener roller 10. The width of the fiber feeding channel 4 (and also of the air conveying channel 6) is precisely as great as the clothing width of the opener roller 10. This is clearly shown in FIG. 2.

The fact that the fiber feeding channel 4 according to FIG. 2 is wider than the opening 11 has the effect on the auxiliary air stream flowing in the air conveying channel 6 that the flow speed in proximity of the feed device 3 is greatest so that the points which are most at risk with respect to a possible adherence of fiber fragments is brushed over by an especially strong air flow.

It will be apparent to those skilled in the art that various modifications and variations can be made in the present invention without departing from the scope or spirit of the invention. Thus, it is intended that the present invention cover such modifications and variations as come within the scope of the appended claims.

I claim:

1. A device for pneumatic feeding of fibers to a fiber collection surface of an open-end spinning element, comprising:

an opener roller provided with a clothing of predetermined width installed in a housing, said opener roller configured to rotate in a rotational direction within said housing thereby defining a circular path for said clothing within said housing, said housing having a fiber-guiding peripheral wall generally surrounding said opener roller and a fiber feeding channel extending from said peripheral wall, said fiber feeding channel defined by a first wall and a second wall generally opposite said first wall, said first wall preceding said second wall with respect to said rotational direction of said clothing in said circular path;

said peripheral wall including a concave section and a generally convex section merging from said concave section preceding said first wall with respect to said circular path in the rotational direction of said opener roller, said first wall of said fiber feeding channel merging from said convex section so that a tangent drawn from the point where said convex section merges from said concave section intersects said second wall of said feeding channel so that fibers opened by said opener roller and carried to said fiber feeding channel are caused to detach from said fiber guiding peripheral wall due to a transition form said concave section to said convex section and are directed into said fiber feeding channel generally away from said first wall of said fiber feeding channel;

a fiber feeding device for feeding a fiber sliver to said opener roller; and means for directing an auxiliary air stream to said fiber feeding channel in a direction which is in opposition to said rotational direction of said clothing in said circular path, said auxiliary air stream being defined generally between said fiber feeding channel and said fiber feeding device with respect to said rotational direction of said clothing in said circular path.

2. The device as in claim 1, wherein said tangent intersects said second wall at a distance from said fiber guiding peripheral wall which is generally less than six times the distance between said first and second fiber feeding channel walls as measured at a perpendicular to a longitudinal axis through said fiber feeding channel at the end of said second fiber feeding channel wall near said peripheral wall.

3. The device as in claim 1, wherein said auxiliary air stream directing means comprises an air channel defined along a section of said fiber guiding peripheral wall adjacent said fiber feeding channel second wall, said air channel opening into said fiber feeding channel.

4. The device as in claim 3, wherein said air channel has a width which is generally equal to said width of said clothing of said opener roller.

5. The device as in claim 4, wherein said fiber feeding channel has an initial width which is generally equal to said width of said clothing and said air channel.

6. The device as in claim 3, wherein said air channel opens into said fiber feeding channel so that an auxiliary airstream drawn through said air channel combines with a main airstream drawn through said fiber feeding channel generally at a zone within said feeding channel which is traversed by said tangent.

7. The device as in claim 3, wherein said air channel comprises a rounded corner at a point where said air channel turns into said fiber feeding channel.

8. A process for pneumatic feeding of fibers to a fiber collection surface of an open-end spinning element, the fibers having been fed in the form of a fiber tuft of a fiber sliver by a feeding device for being opened into individual fibers by clothing of an opener roller having a predetermined width and drawn through a housing around the opener roller to a fiber feeding channel, said process comprising the steps of:

conveying the fibers in a rotational direction of the opener roller by means of a conveying airstream along a concave section of a peripheral fiber guiding wall of the opener roller housing between the opener roller and the housing;

drawing the fibers past a convex section of the peripheral fiber guiding wall prior to the fibers reaching the fiber feeding channel, the convex section merging into a first wall of the fiber feeding channel in the rotational direction of the opener roller, so that the fibers are caused to detach from generally adjacent the peripheral fiber guiding wall and away from the first wall of feeding channel and are drawn generally into the a center zone of the fiber feeding channel; and directing an auxiliary air stream along a portion of the peripheral fiber guiding wall between the feeding device and the fiber feeding channel in a direction generally opposite the rotational direction of the opener roller, and directing the auxiliary airstream into the fiber feeding channel to urge the fibers away from a second wall of the fiber feeding channel opposite the first wall thereof.

9. The process as in claim 8, further comprising directing the auxiliary airstream over a width of the opener roller which is essentially equal to a width of the clothing of the opener roller.

10. The process as in claim 8, further comprising drawing the fibers into a zone of the fiber feeding channel generally where the auxiliary air stream combines with a main airstream drawn through the fiber feeding channel.

11. The process as in claim 10, wherein said fibers having been detached from said first wall of said fiber feeding channel are guided in such a way that they enter said combined main and auxiliary air streams only after the flow profiles of the main and auxiliary air steams have merged.

* * * * *